United States Patent [19]

Gibilisco

[11] Patent Number: 4,832,218

[45] Date of Patent: May 23, 1989

[54] CHILD-RESISTANT CLOSURE DEVICE

[75] Inventor: Kenneth Gibilisco, Warminster, Pa.

[73] Assignee: Merck & Co., Inc., Rahway, N.J.

[21] Appl. No.: 216,642

[22] Filed: Jul. 8, 1988

[51] Int. Cl.[4] ..... B65D 55/02

[52] U.S. Cl. ..... 215/220; 215/219; 215/221

[58] Field of Search ..... 215/203, 219, 220, 221

[56] References Cited

U.S. PATENT DOCUMENTS

| | | | |
|---|---|---|---|
| 2,226,390 | 12/1940 | Rosevear | 215/221 X |
| 3,164,277 | 1/1965 | Reading | 215/221 X |
| 3,756,444 | 9/1973 | McIntosh . | |
| 3,843,006 | 10/1974 | Naito et al. . | |
| 3,885,712 | 5/1975 | Libit | 222/153 |
| 4,011,960 | 3/1977 | Mauvernay et al. | 215/220 |
| 4,223,794 | 9/1980 | Morris | 215/220 |
| 4,271,971 | 6/1981 | Morris | 215/220 |
| 4,281,771 | 8/1981 | Siegel | 215/220 |
| 4,285,437 | 8/1981 | Morris | 215/220 |
| 4,346,809 | 8/1982 | Kusz | 215/214 |
| 4,353,473 | 10/1982 | Morris | 215/220 |
| 4,393,977 | 7/1983 | Willingham | 215/220 X |
| 4,433,789 | 2/1984 | Gibilisco | 215/220 |
| 4,523,688 | 6/1985 | Puresevic et al. | 215/220 |
| 4,553,678 | 11/1985 | Thorsbakken | 215/218 |
| 4,570,809 | 2/1986 | Archer | 215/220 |
| 4,632,264 | 12/1986 | Evans | 215/220 |
| 4,729,487 | 3/1988 | Wright | 215/220 |

*Primary Examiner*—David T. Fidei
*Assistant Examiner*—Nova Stucker
*Attorney, Agent, or Firm*—Lowe, Price, LeBlanc, Becker & Shur

[57] ABSTRACT

A safety closure device for a closeable container is provided which, at the user's option, can be operated in a child-resistant mode of operation or, by a simple one-time action by the user, can be placed in a non-child-resistant mode of operation. An outer cap rotatably and slidingly engages an inner cap that directly closes a container, with an intermediate element biasing the outer and inner caps apart from each other but formed so as to take up a first position in which an axially applied force by the user temporarily non-rotatably couples the inner and outer caps for child-resistant operation, and an axially applied force on the intermediate element coupled with a partial turning of the outer cap relative thereto causes permanent non-rotatable engagement between the outer and inner caps through the intermediate element to make the safety closure non-child-resistant.

10 Claims, 2 Drawing Sheets

CHILD-RESISTANT CLOSURE DEVICE

FIELD OF THE INVENTION

This invention relates generally to child-resistant caps or closure devices suitable for use with containers of potentially harmful substances and, more particularly, to such child-resistant closure devices that can be readily and permanently made non-child-resistant.

BACKGROUND OF THE PRIOR ART

For some time now, it has become commonplace for manufacturers of drugs, medicines and other substances which must be utilized with care to provide containers thereof with child-resistant caps or closure means. These are now available in a variety of designs and most require the user to push on an outer element of a multi-component cap, require the alignment of visible marks, or require the user to squeeze portions of the outer cap to cause engagement with an inner cap portion that is directly threaded on to the container so as to engage the two during unscrewing or opening of the container. There are many situations where, primarily because there are no young children around to accidentally open such containers and ingest their contents, it is highly desirable to place such a child-resistant cap in a mode in which it is non-child-resistant, i.e., it functions simply as a cap that can be threaded or unthreaded onto a container without pressing or squeezing by the user. Various designs have been proposed for this purpose.

U.S. Pat. No. 4,271,971 to Morris, for example, proposes a three-component safety cap for threaded containers, the cap having a rotational actuator element which can be threaded into an inner cap element to permanently engage the same with an outer cap element so that the two become nonrotationally engaged with each other. The rotational actuator element can be unthreaded to reverse this action so as to set the inner and outer caps rotationally free of each other and return the device to its child-resistant mode of operation.

U.S. Pat. No. 4,281,771 to Siegel discloses a child-resistant closure device having an inner cap and an outer cap which can be rotationally locked to each other by the insertion of a user-applied plug passed through an aperture of the outer cap to engage a raised circumferential lug in the inner cap. Removal of the plug by the user reverses this process and renders the closure child-resistant.

U.S. Pat. No. 4,433,789 to Gibilisco, on the other hand, discloses a two-part child-resistant closure in which an outer cap selectively engageable with an inner cap threaded directly to the container can be simply torn off, thereby leaving the inner cap to function as a conventional non-child-resistant cap.

In yet another variation, U.S. Pat. No. 4,553,678 to Thorsbakken discloses a safety cap assembly for bottles, i.e., a child-resistant closure device of the "push-to-turn" type, in which the tearing out or removal of a biasing element between an inner cap and an outer cap rotationally locks the two to render the device non-child-resistant.

The exemplary devices discussed in the immediately preceding paragraphs, while accomplishing a function generally similar to that of the present invention, have various limitations, e.g., they require the user either to add something to the device (such as the removable plug of Siegel) or remove something from the device (the entire outer cap of Gibilisco) or require a definite effort on the part of the user to render the device non-child-resistant (the deliberate threading-in of the rotational actuator element of Morris). There is, therefore, a clear need for a simple child-resistant closure device that may be readily placed in a non-child-resistant mode by a user without the need for adding to or removing parts from the device. The present invention fills this need by providing a child-resistant safety cap which can be rendered permanently and irreversibly non-child-resistant by a single simple action by the user, typically a pharmacist dispensing medication.

SUMMARY OF THE DISCLOSURE

A principal object of this invention is to provide a child-resistant safety closure cap, suitable for use with containers of potentially harmful substances, which cap can be readily converted by the user to become non-child-resistant.

Another object of this invention is to provide a safety closure cap, suitable for use with containers of potentially harmful substances, which can function permanently as a child-resistant closure or, at the user's option, permanently convert to a non-child-resistant closure.

It is a related further object of this invention to provide a safety closure cap, suitable for use with containers of potentially harmful substances, that will function effectively as a child-resistant closure but which can be permanently converted to a non-child-resistant closure by a single action by the user of a type not likely to be taken by a child.

These and other objects of this invention are realized by providing a safety closure for a container, the safety closure being operable in either a child-resistant mode or a non-child-resistant mode at the user's option and formed of three assembled coacting elements. These include an inner container-engaging cap means that engages an opening of a container to close the same, an outer user-graspable cap means coaxially rotatable with and slidingly retained to the inner cap means, and a user-contactable intermediate means located between the caps and normally exerting a bias force tending to separate them axially. When the caps are so biased, a user-applied force to counter the bias force causes engagement between the outer and inner cap means to permit coupled rotation of the two through the intermediate element and the cap is in its child-resistant mode. However, if the user presses on the intermediate element to overcome the bias force, lifts and turns the outer cap means by a predetermined amount and releases the applied force, then the inner and outer caps remain non-rotatably engaged relative to each other and the safety closure is in its non-child-resistant mode.

DETAILED DESCRIPTION OF THE BEST MODE FOR PRACTICING THE INVENTION

Figure 6:
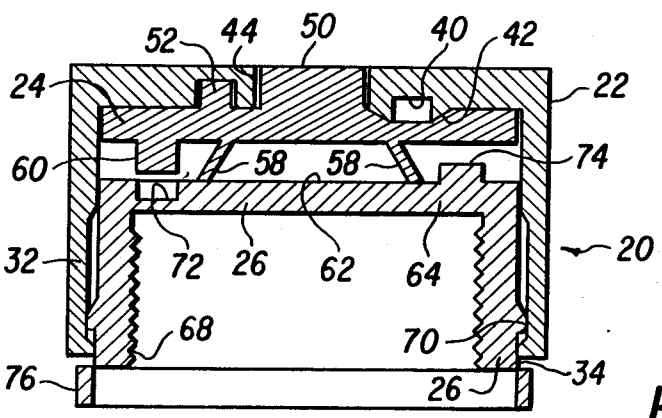
FIG. 6 is a vertical cross-sectional view of the assembled safety closure according to a preferred embodiment of this invention in its child-resistant mode.
Figure 7:
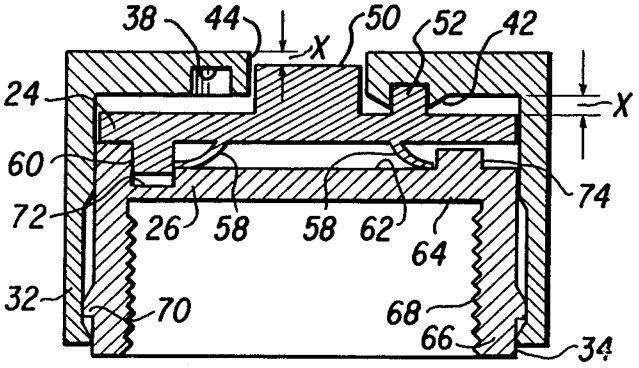
FIG. 7 is a vertical cross-sectional view of the assembled safety closure according to a preferred embodiment of this invention in its non-child-resistant mode.

In a preferred embodiment of the invention, as illustrated in FIGS. 1–7, the safety closure 10 comprises three interconnected parts: an outer cap 22 that is readily graspable by a user (details shown in FIGS. 1 and 2), an intermediate element 24 held inside outer cap 22 (details shown in FIGS. 3–5), and an inner cap 26 that directly contacts and engages at an opening of a container to be closed by the closure means of this invention (best seen in FIGS. 6 and 7). The important details of each of these coacting components and the manner in which they act in combination will now be described.

Outer cap 22 has a generally flat base defined between an outer generally flat surface 28 and an inner generally flat parallel surface 30. This base extends as a generally cylindrical rim relieved in thickness along a portion 33 of its inside surface but having its original thickness at a portion 34 at its very end. The outer user-graspable surface of cylindrical portion 32 may be provided with ridges, roughness or other convenient-to-grasp texture 36.

Figure 1:
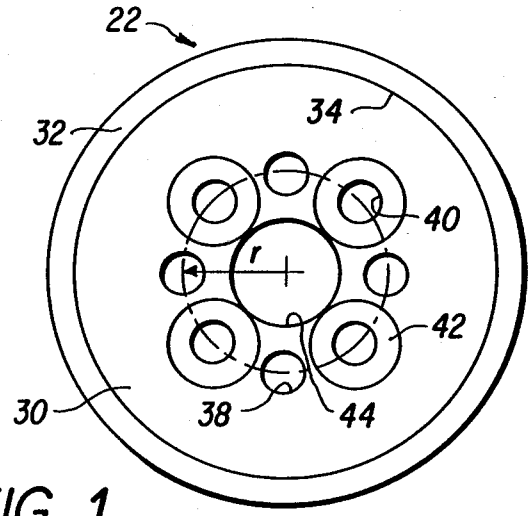
FIG. 1 is a plan view of the inside surface of the base of the outer cap of the safety closure according to a preferred embodiment of this invention.
Figure 2:
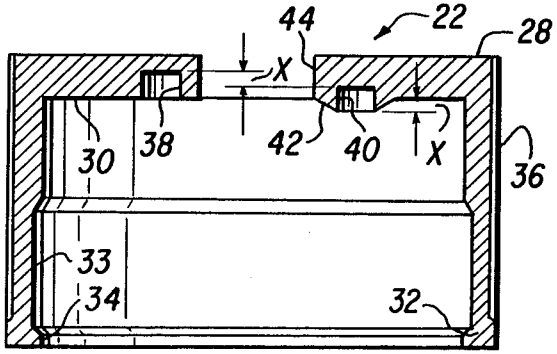
FIG. 2 is a vertical cross-sectional view of the outer cap of FIG. 1 at section 2—2 thereof.

As best understood with reference to FIG. 1, the inside flat surface 30 of the base of outer cap 22 is provided with a plurality of blind recesses 38 distributed evenly about the circumference of a circle of radius "r" with respect to the axis of the outer cap 22. There are four such recesses 38 illustrated in FIGS. 1 and 2 although a different number may be utilized. On the same circumferential line of centers is provided a second plurality of recesses 40 each of which has its base axially separated inwardly from the coplanar bases of first recesses 38 by a distance "x" as best seen in FIG. 2. Also, each of the second set of recesses 40, which is interspersed evenly among the first set of recesses 38, is surrounded by a tapered zone 42. The height of the tapered zone above inner surface 30 of cap 22 is also preferably "x", as best seen in FIG. 2. A through aperture 44 is provided at the center of the base of outer cap 22. This aperture 44 is made of a size sufficient to facilitate a user's application of pressure to a projection 50 of intermediate part 24 to be located therein as is yet to be described.

Figure 3:
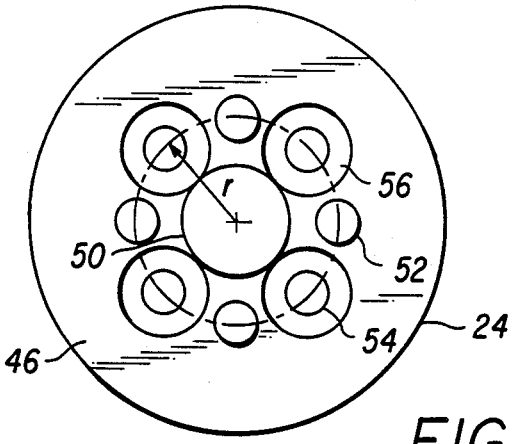
FIG. 3 is a plan view of the top surface of a button element of the safety closure means according to a preferred embodiment of this invention.
Figure 4:
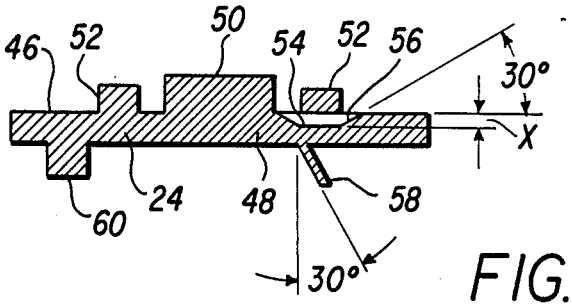
FIG. 4 is a vertical cross-sectional view at section 4—4 of the button element of FIG. 3.
Figure 5:
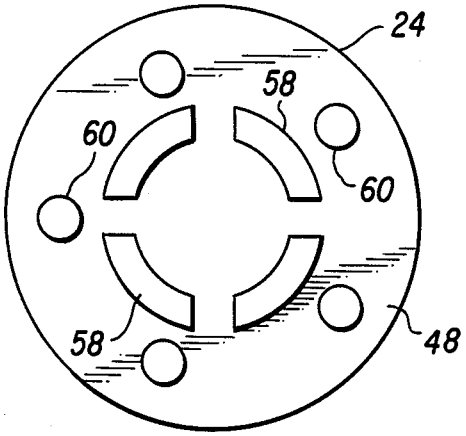
FIG. 5 is a plan view of the lower surface of the button element according to FIG. 3.

Coming now to the intermediate element 24, attention is focused on FIGS. 3, 4 and 5 for details thereof. As best seen in FIG. 4, intermediate element 22 has a generally flat upper surface 46 and a generally flat lower surface 48. A central generally cylindrical projection 50 is provided at the upper flat surface 46 and has a diameter slightly smaller than the diameter selected for aperture 44 in outer cap 22. Still on the upper surface 46, evenly distributed around the axis and central projection 50 is a fist set of generally cylindrical projections 52 evenly distributed around a circumferential line of centers of radius "r" about the axis of symmetry of intermediate element 24. Each of these projections 52 has a diameter slightly smaller than the diameters of recesses 38 and 40 formed in the inner surface of the base of outer cap 22. Likewise, the heights of projections 52 are slightly larger than the depths of recesses 38 and 40. Evenly interspersed among projections 52 and on the same circumferential line of centers is provided a set of tapered depressions 54 having tapered sides 56. The depths of these depressions 54 are at least "x". A convenient taper for the tapered portion 56 is 30° with respect to the flat upper surface 46 of intermediate element 24.

Focusing now on FIGS. 4 and 5, at the lower flat surface 48 of intermediate element 24 is provided a plurality of arcuate inclined extensions 58, preferably inclined at 30° to the axis of symmetry of intermediate element 24. Other values of this angle may be selected to suit particular needs. The arcuate forms of extensions 58 approximately follow the circumferential line of centers of radius "r". At a larger radius circumferential line of centers there is provided on lower surface 48 of intermediate element 24 a plurality of generally cylindrical projections 60. In FIG. 5 there are shown five such projections 60 although other numbers may be conveniently used.

It is now convenient to examine how outer cap 22, intermediate element 24 and inner cap 26 all fit together and coact in both the child-resistant mode and the non-child-resistant mode of operation of the safety closure device according to a preferred embodiment of this invention.

Referring now to FIG. 6, it is seen that intermediate element 24 has an outermost diameter slightly smaller than the inside diameter of cylindrical portion 32 of outer cap 22 and that projections 52 on the upper surface of intermediate element 24 are shaped, sized and distributed in a manner such that they may be slidingly received within recesses 38 provided at the inner surface 30 of outer cap 22. During assembly of the safety closure device, after placement of intermediate element 24 within outer cap 22, as illustrated in FIGS. 6 and 7, inner cap 26 is inserted into cylindrical portion 32 of outer cap 22.

Referring now to either of FIGS. 6 or 7, it is seen that inner cap 26 has a generally flat base defined between surfaces 62 and 64 and has a generally cylindrical portion 66 preferably provided with internal threading 68 shaped and sized to engage matching external threading on a throat containing an opening of the container to be closed by the safety closure device 20. Note also that the outer cylindrical portion of the inner cap is provided with radially outward projections or a rim 70 shaped and sized to slidingly reside within recess portion 33 of the cylindrical side of outer cap 22. The upper generally flat surface 62 of inner cap 26 is provided with a plurality of recesses 72 distributed evenly about the same circumferential line of centers as was employed for distributing projections 60 on the lower surface of intermediate element 24 (see, for example, FIGS. 4 and 5). Recesses 72 are selected to have diameters slightly larger than the diameters of projections 60 so as to receive them slidingly as needed. The upper generally flat surface 62 of inner cap 26 is also provided with at least one projection 74 having a height shorter than the height of a typical projection 60.

Having thus described the various structural features of the three principal elements of the combination according to a preferred embodiment of this invention, it is now possible to discuss the manner in which the various elements coact at the user's option to cause safety closure device 22 to be in a child-resistant mode of operation or, if the user wishes to dispense with this option, be placed permanently in a non-child-resistant mode of operation.

It is intended that arcuate extensions 58 provided at the lower surface of intermediate element 24 be deformable in an elastic manner so as to exert a biasing force when deformed. For practical reasons, therefore, persons skilled in the art will most likely select a substantially elastic material for forming intermediate element 24, e.g., nylon or other comparable tough, relatively inexpensive and easy-to-form plastics material. As a practical matter also, both the outer and inner caps most likely would be made of a plastics material. It should be appreciated that a certain degree of elastic give is required of cylindrical portion 32 of outer cap 22 when inner cap 26 is forcibly inserted so that radially inwardly extending portion 34 of outer cap 22 and radially outwardly extending portion 70 of inner cap 26 can pass each other without permanent deformation or damage.

It should be appreciated with reference to FIG. 6 that when the parts are shaped and sized as illustrated therein arcuate extensions 58 at the lower surface of intermediate element 24 are at most only slightly deformed and the three parts 22, 24 and 26 are relatively free to move rotationally with respect to each other upon the application of external forces. In other words, the parts do not bind to any significant degree but are not sloppily assembled. It may be noted at this point that, in keeping with concerns about the integrity of the contents of the container, a conventional tear-off ring 76 may be formed as part of outer cap 22 and be attached thereto in such a manner that it tears off the first time the safety closure device is operated to open the container (not shown).

When the safety closure is assembled as illustrated in FIG. 6, it is in its child-resistant mode of operation. When inner cap 26 is threaded onto a matching opening of container, outer cap 22 is conveniently pressed axially toward inner cap 26 so that arcuate extensions 58 of intermediate element 24 deform radially outward, projections 52 at the top surface of intermediate element 24 engage with recesses 38 in the inner surface of outer cap 22, downwardly depending projections 60 at the lower surface of intermediate element 24 engage with matchingly disposed recesses 72 in the upper surface of inner cap 26, and torque may be applied through the outer cap and the intermediate element to inner cap 26 to enable closure of the container. Upon release of the externally applied axial force on outer cap 22, due to the elasticity of arcuate extensions 58, outer cap 22 will be biased axially outward of inner cap 26. Under these circumstances, the casual application of merely a torque to outer cap 22 will simply cause it to rotate about inner cap 26 and will neither further tighten nor disengage inner cap 26 from the container. Thus, a young child playing with such a container will be able to turn the outer cap 22 without opening the container. On the other hand, an adult or an older child who wishes to open the container need merely press axially on the outer cap 22 to drive it toward inner cap 26 by deformation of arcuate extensions 58 so that the various projections and recesses engage and permit threading of inner cap 26 with respect to the container closed thereby. It is thus possible to utilize the safety closure according to a preferred embodiment of this invention permanently in this child-resistant mode of operation.

However, as previously discussed, adults may not wish to have to push on the cap every time they wish to open the container and may prefer to permanently place the safety closure device in its non-child-resistant mode of operation. How this is done is described in the next paragraph.

Referring now to FIG. 7, it will be appreciated that if a user pulls outer cap 22 with one hand while the container is resting on a firm surface and pushes axially downward on projection 50 of intermediate element 24, selection of arcuate extensions 58 will permit relative separation between the inner surface 30 of outer cap 22 and the upper surface 46 of intermediate element 24. While the outer cap 22 and the intermediate element 24 are thus axially separated, if the user turns one of them relative to the other, projections 52 of intermediate element 24 which were until then located in the set of recesses 38 will now be moved about the common axis to match the positions of recesses 40 surrounded by tapered portions 42 at the inner surface of outer cap 22. As is readily seen with reference to FIG. 1, this relative rotation need be no greater than only $\frac{1}{8}$ of a turn if recesses 38 and 40 are provided in fours. Therefore, if the user presses on projection 50 of intermediate element 24 sufficiently so as to disengage projections 52 from recesses 38 and turns the outer cap $\frac{1}{8}$ of a turn and then releases the axial force on projection 50 the situation illustrated in FIG. 7 will result. Now, because of the axial separation "x" between the bases of recesses 38 and 40, best understood with reference to FIG. 2, projections 52 of intermediate element 24 will engage recesses 40 of outer cap 22 while, simultaneously, projections 60 of intermediate element 24 will engage recesses 72 of inner cap 26. At this point, the safety closure device, according to this preferred embodiment of the invention, has been placed in its non-child-resistant mode of operation since any torque applied to outer cap 22 will be immediately transferred through the intermediate element 24 to inner cap 26, both to engage and disengage the latter from a container.

Persons skilled in the art will appreciate, of course, that there are other alternatives to the arcuate extensions 58 to provide and ensure the requisite biasing force, e.g., a small circular sponge-like elastic pad or a spring of some sort may be placed between the lower surface of intermediate element 24 and the upper surface of inner cap 26 to generate a comparable bias force. Likewise, persons skilled in the art will appreciate that although the exemplary embodiment illustrated in the figures and described hereinabove has sets of four recesses and projections at the upper portions of intermediate element 24 and five recesses and projections at the lower surface of intermediate element 24, other numbers may be considered for particular applications and may prove advantageous. Based on such considerations, it is anticipated that persons skilled in the art will consider various obvious modifications and variations of the structure and functionalities described herein. All such variations are intended to be comprehended within this invention which is defined solely by the claims.

What is claimed is:

1. A safety closure for a container, that can operate in a child-resistant mode and can be permanently placed in a non-child-resistant mode at a user's option, comprising:

an inner container-engaging cap means for engaging an opening of the container to close the same;

an outer user-graspable cap means coaxially rotatable with and slidingly retained to said inner container-engaging means; and user-contactable intermediate means located intermediate said inner and outer cap means, formed such that in said child-resistant mode of operation of the safety closure said intermediate means exerts an axially oriented force between the inner and outer cap means sufficient to enable free rotational movement therebetween until a first force applied by a user to said outer cap means overcomes said bias force to non-rotatably engage the inner cap means to the outer cap means, said intermediate means also being formed such that when a user applies a second force only to said intermediate means sufficient to overcome said bias force, turns the outer cap means relative to the inner cap means by a predetermined angle and then ceases applying said second force to said intermediate means, said first and second cap means become non-rotatably engaged to said intermediate means and hence to each other to place the safety closure in said non-child-resistant mode of operation.

2. The safety closure of claim 1, wherein:

said intermediate means comprises force means for providing said axially oriented biasing force.

3. The safety closure of claim 2, wherein:

said intermediate means is a single element and said force generating means is an integral elastically deformable portion thereof.

4. The safety closure of claim 3, wherein:

said inner cap means has a generally flat base portion and contiguous therewith a generally cylindrical portion formed to engage a container to close the same, an outside generally flat surface of said base portion having a plurality of first recesses in a predetermined first distribution and at least one outward projection of a first height; and said intermediate element has a lower surface formed to have a plurality of downwardly depending projections of the same number and distribution as the first recesses of said inner cap means but being sized to be slidingly receivable therein.

5. The safety closure of claim 4, wherein:

said lower surface of said intermediate element projects said elastically deformable portion a an arcuate inclined extension of a size such that absent a force applied by a user a contact between said extension and said outside generally flat surface of said inner cap means prevents said downwardly depending projections of the intermediate element from being received within the first recesses of said inner cap means.

6. The safety closure of claim 5, wherein:

said intermediate element has an upper surface formed to have a plurality of upwardly oriented projections in a predetermined second distribution and interspersed therewith a plurality of tapered-wall recesses, and a central upward projection of a predetermined height.

7. The safety closure of claim 6, wherein:

said outer cap means has a generally flat base portion with a central aperture shaped and sized to slidingly receive therein said central upward projection of said intermediate member, said base also having an inside generally flat surface provided with a plurality of first inner cap recesess in a predetermined distribution and size matching that of the upward projections of said intermediate element and interspersed therewith a plurality of second inner cap recesses each surrounded by a conical tapered zone of a shape, size and location to match corresponding tapered-wall recesses of said intermediate element, the bases of the first inner cap recesses being closer by a predetermined dimension to the outside generally flat surface of said outer cap means than are the bases of said tapered wall recesses in said intermediate element, whereby, when said upward projections of said intermediate element are slidingly received into said first inner cap recesses said elastically deformable portions of said intermediate element are deformed to exert a corresponding bias force and said downward projections of said intermediate element are non-rotatably received into said first recesses of said inner cap means.

8. The safety closure of claim 7, wherein:

said outer cap means and said inner cap means are respectively formed to be slidingly retained to each other regardless of any relative rotation therebetween.

9. The safety closure of claim 8, wherein:

said inner and outer cap means and said intermediate element all comprise suitable plastics material.

10. A container with a safety closure means engageable to close an opening of the container, that can be easily rendered child-resistant or non-child-resistant at a user's option, comprising:

a container means provided with an opening for removal of contents of the container therefrom; and a safety closure means for engaging said container opening to close the same, comprising an inner container-engaging cap means for engaging an opening of the container to close the same, an outer user-graspable cap means coaxially rotatable with and slidingly retained to said inner container-engaging means, and user-contactable intermediate means located intermediate said inner and outer cap means, formed such that in said child-resistant mode of operation of the safety closure said intermediate means exerts an axially oriented force between the inner and outer cap means sufficient to enable free rotational movement therebetween until a first force applied by a user to said outer cap means overcomes said bias force to non-rotatably engage the inner cap means to the outer cap means, said intermediate means also being formed such that when a user applies a second force only to said intermediate mean sufficient to overcome said bias force, turns the outer cap means relative to the inner cap means by a predetermined angle and then ceases applying said second force to said intermediate means, said first and second cap means become non-rotatably engaged to said intermediate means and hence to each other to place the safety closure in said non-child-resistant mode of operation.

* * * * *